US006984357B2

(12) United States Patent
Kim et al.

(10) Patent No.: US 6,984,357 B2
(45) Date of Patent: Jan. 10, 2006

(54) APPARATUS AND METHOD FOR HOLDING MOLTEN METAL IN CONTINUOUS HOT DIP COATING OF METAL STRIP

(75) Inventors: Ho-Young Kim, Pohang (KR); Jong-Keun Kim, Pohang (KR); Goo-Hwa Kim, Pohang (KR); Hee-Tae Jeong, Pohang (KR); Min-Su Yoon, Pohang (KR); Anastasia Kolesnichenko, Pohang (KR)

(73) Assignees: Posco, Kyungsangbuk-do (KR); Research Institute of Industrial Science & Technology, Kyungsangbuk-do (KR)

( * ) Notice: Subject to any disclaimer, the term of this patent is extended or adjusted under 35 U.S.C. 154(b) by 60 days.

(21) Appl. No.: 10/297,741

(22) PCT Filed: Apr. 10, 2002

(86) PCT No.: PCT/KR02/00644

§ 371 (c)(1),
(2), (4) Date: Dec. 6, 2002

(87) PCT Pub. No.: WO02/083970

PCT Pub. Date: Oct. 24, 2002

(65) Prior Publication Data

US 2003/0161965 A1 Aug. 28, 2003

(30) Foreign Application Priority Data

Apr. 10, 2001 (KR) ..... 2001-18844
Dec. 21, 2001 (KR) ..... 2001-83012

(51) Int. Cl.
*C21C 5/42* (2006.01)

(52) U.S. Cl. ..... 266/237; 266/275

(58) Field of Classification Search ..... 427/431, 427/433, 310; 266/275, 237, 44
See application file for complete search history.

(56) References Cited

U.S. PATENT DOCUMENTS 5,512,321 A 4/1996 Paramonov et al.
5,665,437 A 9/1997 Frommann et al.

(Continued)

FOREIGN PATENT DOCUMENTS

JP 63109148 5/1988

(Continued)

OTHER PUBLICATIONS

Patent Abstracts of Japan, translation of JP 10-195618, Mashiko et al, Jul. 1998.*

*Primary Examiner*—Scott Kastler
(74) *Attorney, Agent, or Firm*—Baker Botts LLP

(57) ABSTRACT

A molten metal holding apparatus for the continuous hot dip coating of a metal strip includes a vessel that is substantially rectangular in cross section having long sides and short sides and has formed a slot-shaped opening in a bottom surface, the vessel containing molten metal; subsidiary vessels formed following an outer circumference of an upper end of the vessal and for temporarily storing molten metal that overflows from the upper end of the vessel; chambers formed outwardly following long sides of a lower end of the vessel and that communicate with the vessel via slit-shaped branch openings formed at a predetermined slant toward the vessel; a plurality of subsidiary tubes communicating with the subsidiary vessels; and alternating current electromagnets including a core mounted adjacent to outside side surfaces of the vessel and between the subsidiary vessels and the chambers and a coil wound around the core and to which an alternating current is supplied.

15 Claims, 8 Drawing Sheets

U.S. PATENT DOCUMENTS

| | | | | |
|---|---|---|---|---|
| 5,702,528 | A | | 12/1997 | Paramonov et al. |
| 5,897,683 | A | | 4/1999 | Unoki et al. |
| 6,037,011 | A | * | 3/2000 | Deegan et al. ..... 427/433 |

FOREIGN PATENT DOCUMENTS

| | | |
|---|---|---|
| JP | 63303045 | 12/1988 |
| JP | 63310949 | 12/1988 |
| JP | 63317656 | 12/1988 |
| JP | 5078802 | 3/1993 |
| JP | 913155 | 1/1997 |
| JP | 11209858 | 8/1999 |

* cited by examiner

APPARATUS AND METHOD FOR HOLDING MOLTEN METAL IN CONTINUOUS HOT DIP COATING OF METAL STRIP

BACKGROUND OF THE INVENTION (a) Field of the Invention

The present invention relates to an apparatus for holding molten metal in continuous hot dip coating of a metal strip. More particularly, the present invention relates to a molten metal holding apparatus for the continuous hot dip coating of a metal strip, in which a metal strip is passed through a vessel filled with a molten coating metal and an electromagnetic field is used during the coating process to stably float the molten metal.

(b) Description of the Related Art

In continuous hot dip coating of metal strips, metal strips are continuously passed through a vessel filled with a molten metal, which is used as a coating solution. As shown in FIG. 15, in the conventional continuous hot dip coating method, a vessel 83 is filled with a molten metal 81, which is obtained by melting a metal by using as a metal solution aluminum, zinc, or an alloy of these metals, and a metal strip 89 that is continuously supplied to the vessel 83 using a sink roll 85 and a stabilizing roll 86 is dipped in the molten metal 81, after which the metal strip 89 is removed from the vessel 83.

The sink roll 85 acts to change a direction at which the metal strip 89 travels, and the stabilizing roll 86 acts to adjust the conveying state of the metal strip 89. The sink roll 85 and the stabilizing roll 86 are submerged in the molten metal 81 in the vessel 83, and axis members of the sink roll 85 and the stabilizing roll 86 are supported by a sleeve-bush configuration and without the use of lubrication as a result of the high temperature environment of inside the vessel 83.

At this time, parts forming the sink and stabilizing rolls 85 and 86 react with the molten metal 81 to generate metal compounds. If impurities created as a result adhere to a surface of the metal strip 89, the metal strip 89 is compressed in this state to reduce the quality of the metal strip 89.

Further, the rotation of the axis members of the sink and stabilizing rolls 85 and 86 without the use of lubricant results in wear of the axis members. This causes the metal strip 89 to vibrate to thereby result in defects such as a streaked pattern formed on the metal strip 89 or differences in the amount of coating.

To solve such problems, it is necessary to use a vessel structure in which such rolls are not submerged in the molten metal. In this regard, a molten metal process is disclosed that eliminates the use of metal strip support rolls that are submerged in the molten metal. In such a process, an opening through which the metal strip is supplied is formed in a lower section of a vessel. A metal strip to be plated is supplied to a lower portion of the molten metal through the opening then removed from the vessel through an upper section thereof. A configuration for preventing the molten metal from exiting through the opening is provided.

With regard to the configuration for preventing the molten metal from exiting through the opening in such a process where rolls submerged in molten metal are not used, Japanese Patent Laid-Open No. 63-109148 discloses a method in which gas pressure obtained by a gas pressure chamber mounted in the vicinity of the opening of the vessel is used to support the weight of the molten metal so that it floats. Also, Japanese Patent Laid-Open No. 63-303045 discloses a method in which a direct-current (DC) magnet is mounted in the area of the opening to supply a direct current to the molten metal such that it floats by the generated electromagnetic force.

In addition, U.S. Pat. No. 5,665,437 and Japanese Patent Laid-Open No. 63-310949 mount a linear induction motor in the area of the opening of the vessel to form a traveling magnetic field. The electromagnetic force formed as a result floats the molten metal. U.S. Pat. No. 5,897,683 discloses a holding method that uses an electromagnetic force generated by an alternating-current (AC) electromagnet mounted in the vicinity of the opening of the vessel and a conducting block in a specific area of the vessel, and uses a gas pressure obtained by providing a gas pressure chamber below the opening so that the molten metal does not exit the opening.

However, among the configurations and processes disclosed as described above, in the methods using gas pressure to float the molten metal, it is difficult to maintain a uniform pressure of the gas pressure chamber and a significant noise is generated. Also, if the gas permeates the molten metal, bubbles may form within the molten metal.

In the methods of holding the molten metal using a DC magnet and a DC source, DC current may pass through the metal strip to affect peripheral equipment. This poses safety risks to users.

Further, in the method of mounting a linear induction motor in the area of the vessel opening to float the molten metal, the metal strip passing through the opening may be deformed.

Finally, in the method of simultaneously using the AC electromagnet and the gas pressure chamber to float the molten metal, significant costs are involved by using both these configurations and gas may permeate the molten metal to form bubbles therein. Also, not only is it difficult to maintain the original shape of the conductor dipped in the molten metal, but also it is difficult to maintain the chemical composition of the molten metal itself.

SUMMARY OF THE INVENTION

It is one object of the present invention to provide a molten metal holding apparatus for the continuous hot dip coating of a metal strip, in which an electromagnetic force generating apparatus, which is made of an electromagnet core and an electromagnetic coil, is mounted in proximity to a lower portion of a vessel so that molten metal does not escape through an opening of a bottom surface of the vessel.

It is another object of the present invention to provide a molten metal holding apparatus for the continuous hot dip coating of a metal strip, in which a molten metal in a vessel is circulated through an external path to re-supply the molten metal into the vessel from a lower portion thereof, thereby maintaining a more stable molten metal floating state in an opening area of a bottom surface of the vessel.

It is yet another object of the present invention to provide a molten metal holding apparatus for the continuous hot dip coating of a metal strip, in which molten metal solidification layers are artificially formed within lower portions of short sides of a vessel such that a floating state of the molten metal is more stably maintained.

The molten metal holding apparatus for the continuous hot dip coating of a metal strip includes a vessel that is substantially rectangular in cross section having long sides and short sides and has formed a slot-shaped opening in a bottom surface, the vessel containing molten metal; subsidiary vessels formed in a bucket-shape following an outer circumference of an upper end of the vessel and for temporarily storing molten metal that overflows from the upper end of the vessel; chambers formed outwardly following long sides of a lower end of the vessel and that communicate with the vessel via slit-shaped branch openings that are formed at a predetermined slant toward the vessel; a plurality of subsidiary tubes communicating the chambers with the subsidiary vessels; and alternating current electromagnets including a core mounted adjacent to outside side surfaces of the vessel and between the subsidiary vessels and the chambers and a coil wound around the core and to which an alternating current is supplied.

Exhaust openings are formed in upper long sides of the vessel such that the molten metal may be exhausted from the vessel to the subsidiary vessels.

At least one subsidiary tube is formed in each corner portion of the vessels.

The subsidiary tubes are provided outwardly adjacent to a pair of opposing poles of the cores of the electromagnets. Also, the subsidiary tubes are provided between opposing poles of the cores of the electromagnets. The subsidiary tubes are provided external to yokes of the cores of the electromagnets.

Molten metal supplied through the branch openings have an angle in the range of 30° to 45° with a metal strip supplied through the opening formed in the bottom surface of the vessel.

In an alternative preferred embodiment of the present invention, the molten metal holding apparatus for continuously plating a metal strip includes a vessel that is substantially rectangular in cross section having long sides and short sides and has formed a slot-shaped opening in a bottom, surface, the vessel containing molten metal; alternating current electromagnets mounted adjacent to outside, lower long side surfaces of the vessel; and molten metal coolers mounted adjacent to outside, lower short side surfaces of the vessel for forming solidification layers inside the vessel at a lower end of the short sides thereof.

The metal holding apparatus further includes a temperature sensor provided at each an inner lower surface of the short sides of the vessel where the solidification layers are formed and an outer lower surface of the short sides of the vessel; a coolant supply valve connected to the molten metal coolers and controlled to regulate the amount of coolant supplied to the molten metal coolers; and a controller connected to the temperature sensors and the coolant supply valve to control the supply amount of coolant according to the detected temperatures to thereby control a thickness of the solidification layers formed inside the vessel.

A molten metal holding method in a process for the continuous hot dip coating of a metal strip includes supplying an alternating current to a coil of an alternating current electromagnet, which is mounted adjacent to an outer lower surface of long sides of a vessel to thereby generate electromagnetic force in the vessel in a direction opposite that of the gravitational force; and supplying a coolant to molten metal coolers to cool lower short sides of the vessel, thereby resulting in the formation of molten metal solidification layers within the vessel at lower short side areas thereof.

The formation of the molten metal solidification layers in the method includes measuring temperatures within and outside the lower short sides of the vessel; calculating a desired thickness of the solidification layers according to a difference in the temperatures within and outside the lower short sides of the vessel, and determining an amount of coolant to be supplied to the molten metal coolers; and supplying coolant to the molten metal coolers in the determined amount.

In yet another alternative preferred embodiment of the present invention, the molten metal holding apparatus for the continuous hot dip coating of a metal strip includes a vessel that is substantially rectangular in cross section having long sides and short sides and has formed a slot-shaped opening in a bottom surface, the vessel containing molten metal; subsidiary vessels formed in a bucket-shape following an outer circumference of an upper end of the vessel and for temporarily storing molten metal that overflows from the upper end of the vessel; chambers formed outwardly following long sides of a lower end of the vessel and that communicate with the vessel via slit-shaped branch openings that are formed at a predetermined slant toward the vessel; a plurality of subsidiary tubes communicating the chambers with the subsidiary vessels; alternating current electromagnets including a core mounted adjacent to outside side surfaces of the vessel and between the subsidiary vessels and the chambers and a coil wound around the core and to which an alternating current is supplied; and molten metal coolers mounted adjacent to outside, lower short side surfaces of the vessel for forming solidification layers inside the vessel at a lower end of the short sides thereof.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
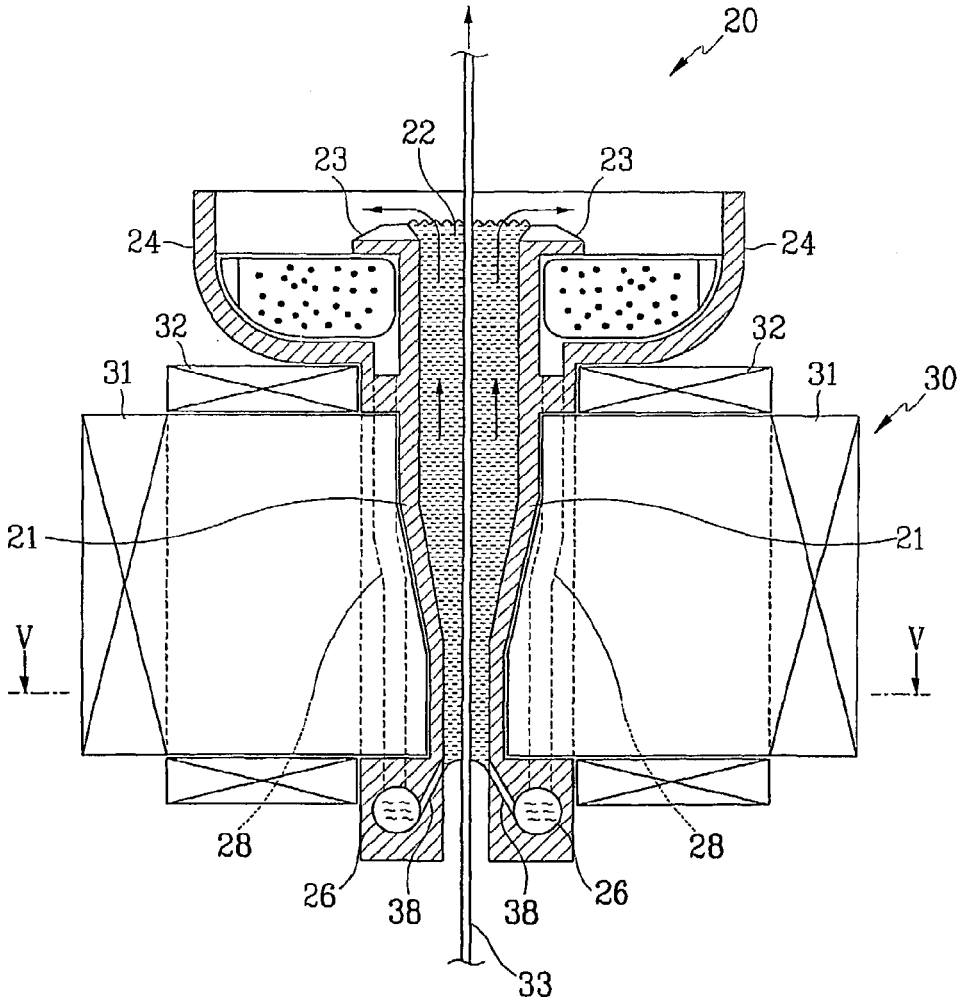
FIG. 1 is a schematic longitudinal sectional view of a molten metal holding apparatus according to a first preferred embodiment of the present invention.

FIG. 1 is a schematic longitudinal sectional view of a molten metal holding apparatus according to a first preferred embodiment of the present invention.

As shown in FIG. 1, a molten metal holding apparatus 20 is used for the continuous hot dip coating of a metal strip, and includes main elements of a vessel 21 containing molten metal 22 and having formed in a bottom surface a slot-shaped opening, and an alternating current (AC) electromagnet 30 mounted adjacent to outer side surfaces of the vessel 21. The AC electromagnet 30 provides buoyancy to the molten metal 22 so that it does not exit through the opening of the vessel 21.

The vessel 21 is substantially rectangular in cross section such that it has long sides and short sides. A metal strip 33 is supplied through the slot-shaped opening formed in the bottom surface of the vessel 21. Bucket-shaped subsidiary vessels 24 are formed on an upper end of the vessel 21 following an outer circumference of an upper end of the same. The subsidiary vessels 24 temporarily store the molten metal 22 that flows out from the upper end of the vessel 21. A pair of the subsidiary vessels 24 may be provided, with the subsidiary vessels 24 being provided adjacent to the long sides of the vessel 21 and symmetrically about the metal strip 33 that passes through the vessel 21.

Figure 2:
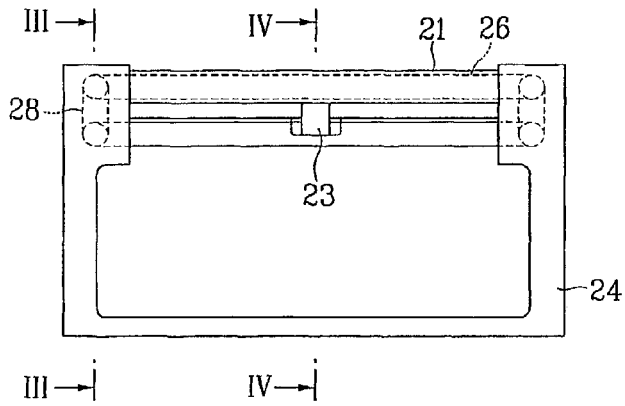
FIG. 2 is a partial plan view of the molten metal holding apparatus of FIG. 1.

FIG. 2 is a partial plan view of the molten metal holding apparatus of FIG. 1 showing one of the subsidiary vessels 24.

As shown in the drawing, an exhaust opening 23 is formed in an upper side surface of a long side of the vessel 21, the long side of the vessel 21 forming one side wall of the subsidiary vessel 24. The exhaust opening 23 allows the molten metal 22 to easily spill over into the subsidiary vessel 24.

A chamber 26 is formed at a bottom end of the vessel 21. Also, a slit-shaped branch opening 38 is formed upwardly at a predetermined angle extending from the chamber 26 to the vessel 21 such that the chamber 26 is communicated with the inside of the vessel 21.

It is preferable that each of the chambers 26 includes a tube-shaped configuration following the long side of the vessel 21 for communication with the corresponding subsidiary vessel 24. Further, it is preferable that the branch openings 38 have a long slit shape that is formed at a predetermined angle to the long side of the vessel 21.

Figure 3:
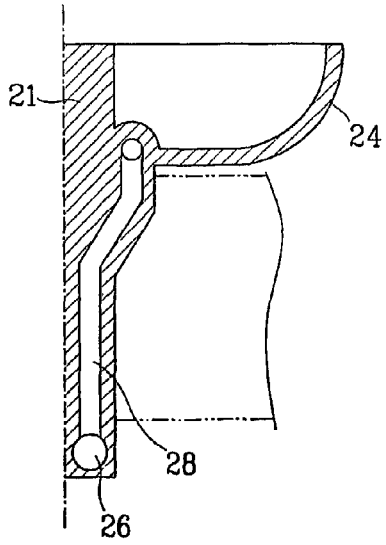
FIG. 3 is a sectional view taken along line III—III of FIG. 2.
Figure 4:
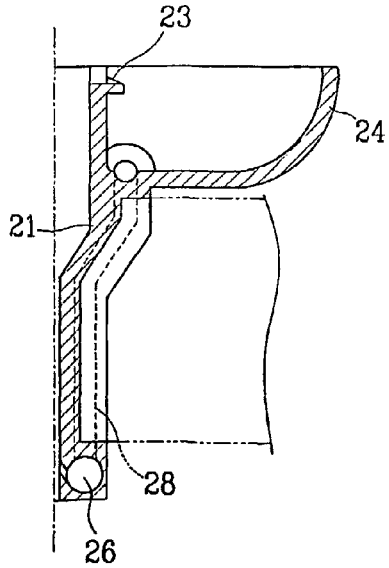
FIG. 4 is a sectional view taken along line IV—IV of FIG. 2.

FIG. 3 is a sectional view taken along line III—III of FIG. 2, and FIG. 4 is a sectional view taken along line IV—IV of FIG. 2.

As shown in FIGS. 3 and 4, the subsidiary vessel 24 and the chamber 26 (the drawings show one of a pair of each element) are communicated through a plurality of subsidiary tubes 28. The subsidiary tubes 28 extend downward following the side wall of the vessel 21 starting from a bottom surface of the subsidiary vessel 24 and continuing until reaching an upper surface of the chamber 26.

Figure 5:
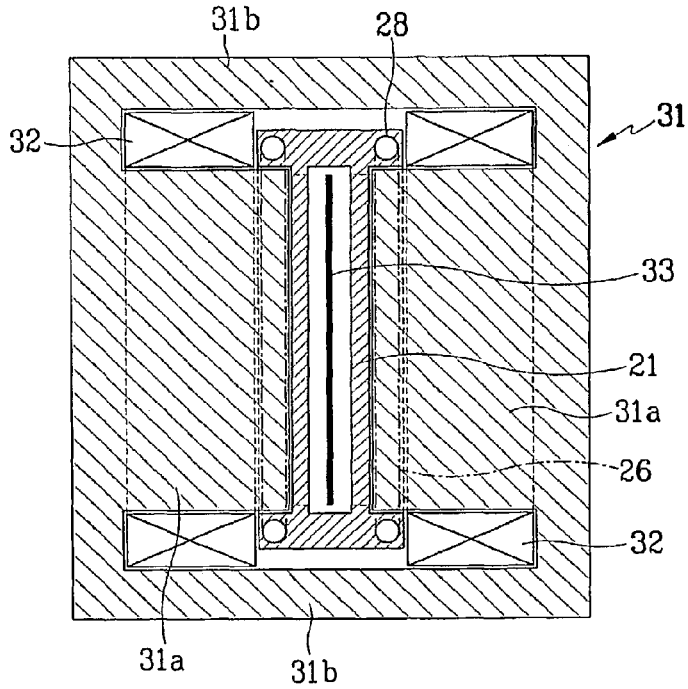
FIG. 5 is a sectional view taken along line V—V of FIG. 1.

Further, the subsidiary tubes 28, with reference to FIG. 5, may start their formation in each corner of the vessel 21, which is substantially rectangular in cross section as described above. The molten metal 22 temporarily stored in the subsidiary vessels 24 after flowing out of the vessel 21 flows to the chambers 26 through the subsidiary tubes 28.

As described above, the AC electromagnet 30 is mounted adjacent to the outer side surfaces of the vessel 21. The AC electromagnet 30 includes a core 31 mounted adjacent to the long walls of the vessel 21 between the subsidiary vessels 24 and the chambers 26, and a coil 32 wound around the core 31. The core 31 includes poles opposing one another with the vessel 21 therebetween, and a yoke connecting the poles. The coil 32 is wound around the poles of the core 31, with AC current being supplied through the coil 32 during operation. It is preferable that the poles of the core 31 have a width at least as great as a width of the long sides of the vessel 21.

Figure 6:
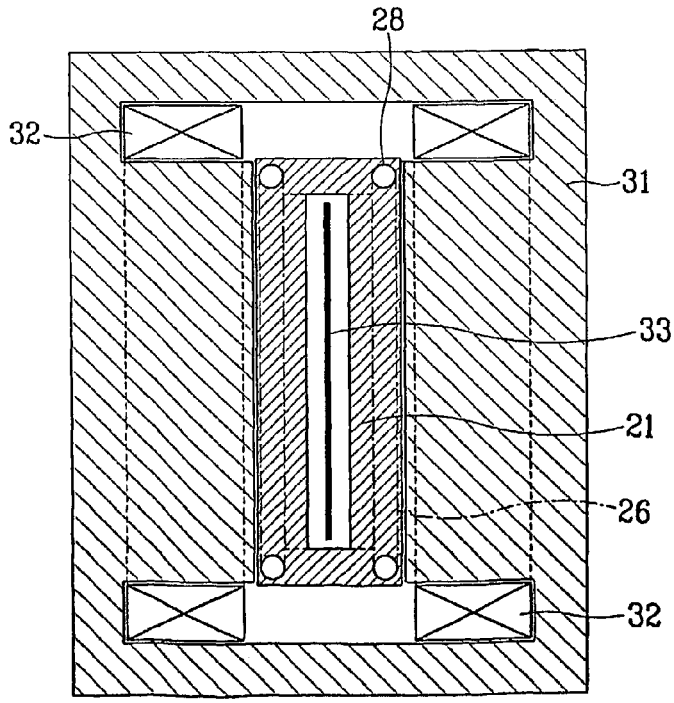
FIG. 6 is a transverse sectional view of a molten metal holding apparatus according to an alternate preferred embodiment of the present invention.

The subsidiary tubes 28, with reference again to FIG. 5, may be formed outwardly from a pair of the opposing poles 31*a* of the core 31. As shown in FIG. 6, it is possible for the subsidiary tubes 28 to be formed between the pair of the poles 31*a*.

Separate ports are formed externally to the yoke 31*b* of the core 31. Also, subsidiary tubes connecting the subsidiary vessels 24 and the ports, and subsidiary tubes connecting the ports and the chamber 26 are formed to enable the transmission of the molten metal. At this time, the ports may move upwardly and downwardly to adjust the amount of the molten metal that is circulated.

An operation of the molten metal holding apparatus according to the first preferred embodiment of the present invention will now be described.

Figure 7:
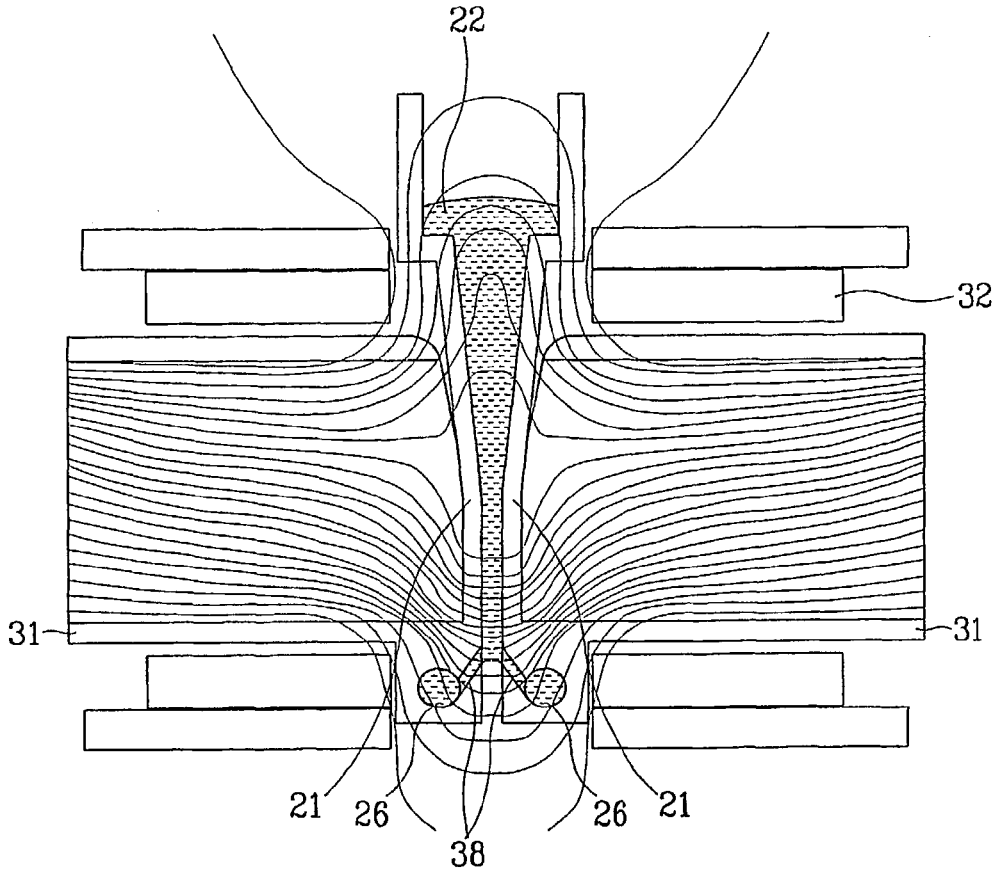
FIG. 7 is a schematic view for interpreting an electromagnetic field formed in a molten metal holding apparatus according to the present invention.
Figure 8:
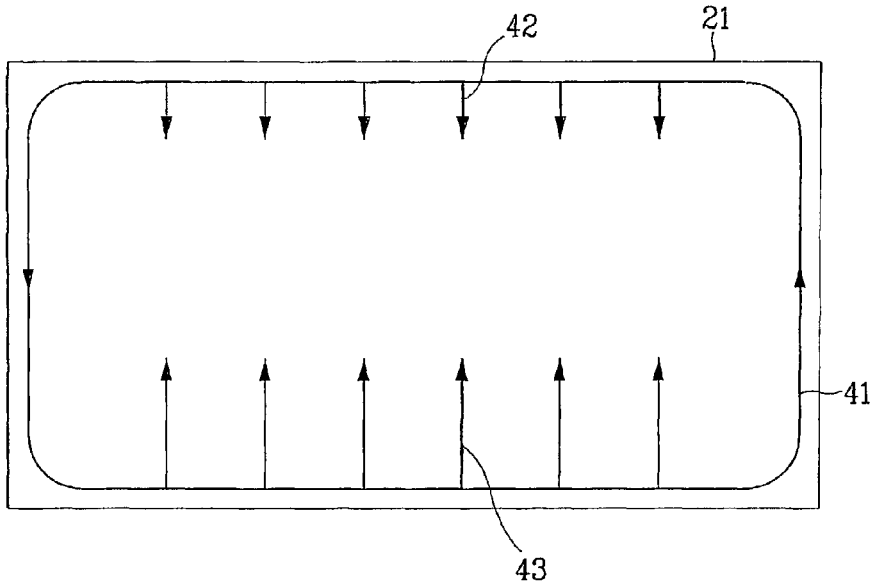
FIG. 8 is a schematic view for schematically illustrating induced current and electromagnetic force generated in a vessel of a molten metal holding apparatus according to the present invention.

First, the vessel 21 and the subsidiary tubes 28 are filled with molten metal 22. If an AC current is then supplied to the coil 32 of the AC electromagnet 30, an electromagnetic field is formed in the vessel 21 by the AC electromagnet 30 as shown in FIG. 7. At this time, an induced current is formed in the molten metal 22 filled in the vessel 21 such that a single current flow path 41 is formed as shown in FIG. 8. By the induced current and the electromagnetic field, a Lorentz force expressed by the vector product of the induced current and the electromagnetic field, that is, the electromagnetic force operates toward a center direction of the current flow path 41, the intensity of which is proportional to the product of the induced current and the electromagnetic field. Accordingly, an electromagnetic force acts 43 in a direction opposite to the direction of the gravitational force at the bottom portion of the vessel 21, while an electromagnetic force 42 acts in a direction corresponding to the direction of the gravitational force at the top portion of the vessel 21.

In the molten metal holding apparatus of the first preferred embodiment of the present invention, the AC electromagnet 30 is in close proximity to the opening of the vessel 21 by the increasingly narrowly formed outer circumference of the vessel 21 at the bottom portion thereof. As a result, with reference again to FIG. 8, the electromagnetic force 43 acting in a direction opposite that of the force of gravity at the bottom portion of the vessel 21 is increased in strength, while the electromagnetic force 42 acting at the upper portion of the vessel 21 is relatively weak. Therefore, the total electromagnetic force acting on the molten metal 22 in the vessel 21 acts in a direction opposite the direction of the gravitational force such that the molten metal 22 in the vessel 21 floats.

The molten metal 22 floating in this manner within the vessel 21 spills over into the subsidiary vessels 24 through the exhaust openings 23 formed in the upper portions of the vessel 21, then this molten metal 22 flows through the subsidiary tubes 28, upper ends of which are formed starting from the bottom of the subsidiary vessels 24. The molten metal 22 then flows through the subsidiary tubes 28 from the subsidiary vessels 24 into the chambers 26. Next, the molten metal 22 that enters the chambers 26 is sprayed into the vessel in a free flat jet form through the branch openings 38 by hydrostatic pressure depending on the height of the subsidiary tubes 28 and the electromagnetic force generated by the AC electromagnet 30.

Figure 9:
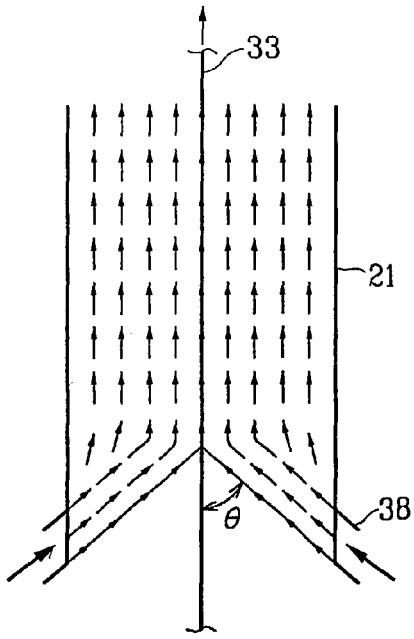
FIG. 9 is a schematic view showing numerical analysis results of flow fields of molten metal in the vicinity of a vessel lower opening portion of a molten metal holding apparatus according to the present invention.

FIG. 9 is a schematic view showing numerical analysis results of flow fields of the molten metal in the lower portion area of the vessel 21 in the molten metal holding apparatus according to the present invention.

As shown in the drawing, the free flat jet flows through the branch openings 38 having a predetermined angle (θ) with the supplied metal strip 33, that is, inner most lines formed by the flow of the molten metal 22 have the predetermined angle (θ) with the metal strip 33 that is supplied to the molten metal holding apparatus. The angle (θ) is preferably between 30° and 45° in order to ensure the most stable floating of the molten metal 22. If the angle (θ) is less than 30°, the free flat jet flow meeting the metal strip 33 excessively slows, and if the angle (θ) is greater than 45°, the free flat jet flow strikes the metal strip 33 and splashes downwardly away from the intended flow direction.

The molten metal 22 sprayed in this manner enters into the vessel 21 at a location close to the metal strip 33 in the vicinity of the lower opening portion of the vessel 21. Also, this molten metal 22 not only has a velocity in a direction opposite that of the force of gravity, but an induced current path generated by the electromagnetic field is always ensured by the molten metal already in this area. Therefore, a free surface of the molten metal floating by the electromagnetic force in the lower opening portion of the vessel 21 is kinetically stabilized such that the floating of the molten metal 22 is stably maintained.

The molten metal 22 circulated as described above is reduced in amount as it coats the metal strip 33 passing through the vessel 21 such that it is necessary to continuously or periodically replenish the supply of the molten metal 22.

The intensity of the electromagnetic force generated by the AC electromagnet 30 is proportional to the square of the amount of current supplied to the coil 32. As a result, prevention of the exiting of the molten metal 22 by the free flat jet flow sprayed through the branch openings 38 may be stably realized by adjusting the amount of current supplied to the coil 32 and adjusting the vertical height of the molten metal 22 in the subsidiary vessels 24.

Figure 10:
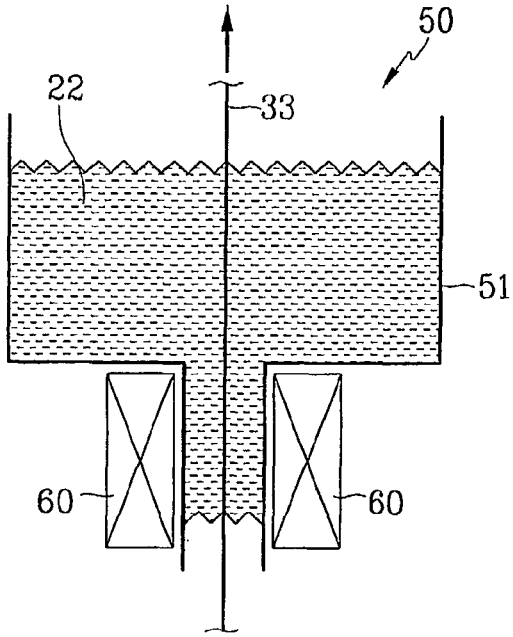
FIG. 10 is a side sectional view of a molten metal holding apparatus according to a second preferred embodiment of the present invention.
Figure 11:
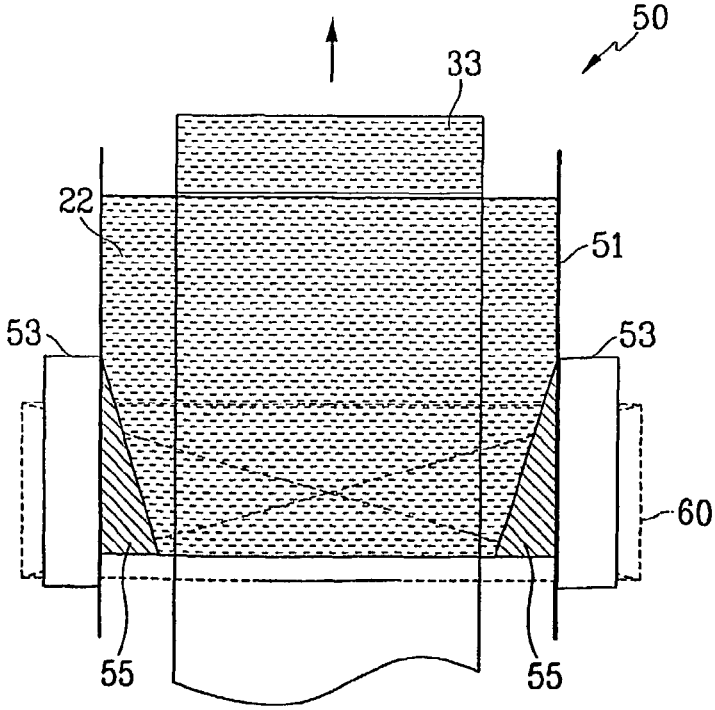
FIG. 11 is a front sectional view of the molten metal holding apparatus of FIG. 10.

FIG. 10 is a side sectional view of a molten metal holding apparatus according to a second preferred embodiment of the present invention, and FIG. 11 is a front sectional view of the molten metal holding apparatus of FIG. 10.

With reference to the drawings, a molten metal holding apparatus 50 according to the second preferred embodiment of the present invention includes main elements of a vessel 51 containing molten metal 22, AC electromagnets 60 mounted adjacent to outer side surfaces of the vessel 51 for providing buoyancy to the molten, metal 22 in the vessel 51, and molten metal coolers 53 for forming solidification layers 55 of the molten metal 22 in lower portions within the vessel 51 corresponding to where the molten metal coolers 53 are provided. The vessel 51 is substantially rectangular in cross section having long sides and short sides. A slot-shaped opening is formed in a bottom surface of the vessel 51 through which a metal strip 33 is supplied.

A pair of the AC electromagnets 60 is provided and they are mounted adjacent to a lower outer surface of the long sides of the vessel 51. The AC electromagnets 60 oppose one another symmetrically about the metal strip 33 when the same is supplied to the vessel 51. The molten metal coolers 53 are mounted to a lower outer surface of the short sides of the vessel 51. When operated, the molten metal coolers 53 form solidification layers 55 of the molten metal 22 at lower areas within the vessel 51 next to the short sides of the same.

Figure 12:
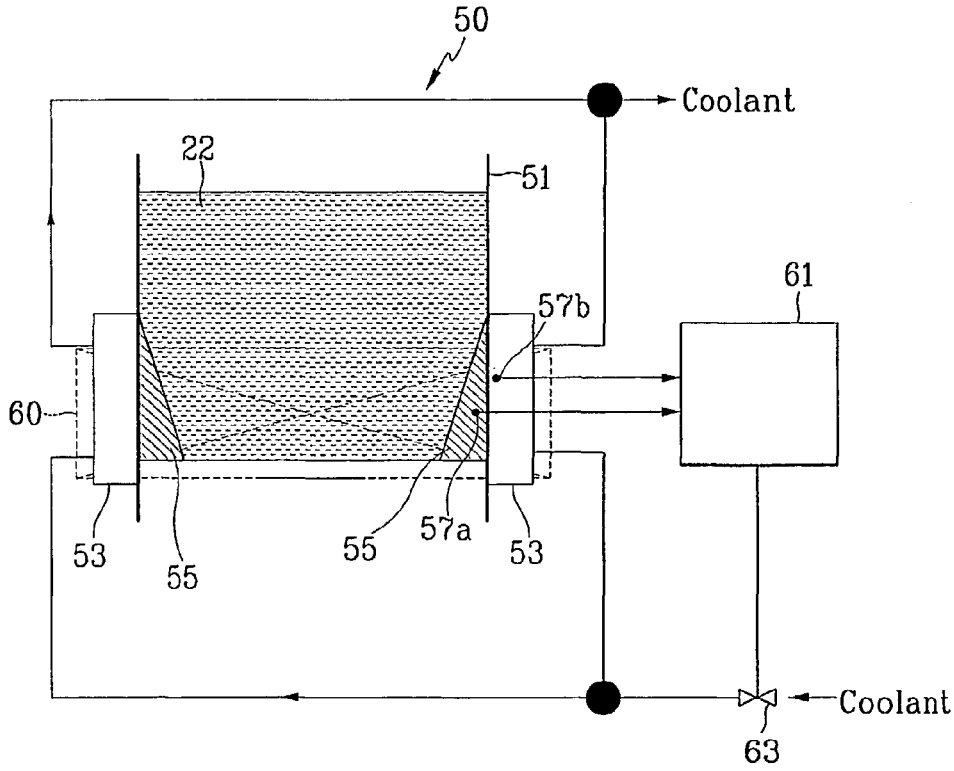
FIG. 12 is a schematic view for describing molten metal coolers of the molten metal holding apparatus of FIG. 10.

FIG. 12 is a schematic view for describing the molten metal coolers 53 of the molten metal holding apparatus of FIG. 10.

With reference to the drawing, a configuration for the supply and exhaust of coolant to and from the molten metal coolers 53 is provided thereon. With respect to the supply of coolant to the molten metal coolers 53, there are provided temperature sensors 57*a* and 57*b* respectively inside and outside the vessel 51, a coolant supply valve 63 controlled to regulate the amount of coolant supplied to the molten metal coolers 53, and a controller 61 for controlling the supply of the coolant according to the sensed temperatures so that a thickness of the solidification layers 55 may be adjusted.

The temperature sensors 57*a* and 57*b* are provided at a height respectively inside and outside the vessel 51 corresponding to where the solidification layers 55 are formed. The temperatures detected by the temperature sensors 57*a* and 57*b* are transmitted to the controller 61. The coolant supply valve 63 is connected to each of the molten metal coolers 53, and is also connected to the controller 61. The controller 61 then is connected to the coolant supply valve 63 as well as to the temperature sensors 57*a* and 57*b*. Depending on the temperatures detected by the temperature sensors 57*a* and 57*b*, the controller 61 outputs signals to the coolant supply valve 63 to adjust the amount of coolant that is supplied to the molten metal coolers 53. The thickness of the solidification layers 55 in the vessel 51 is controlled by this process.

Figure 13:
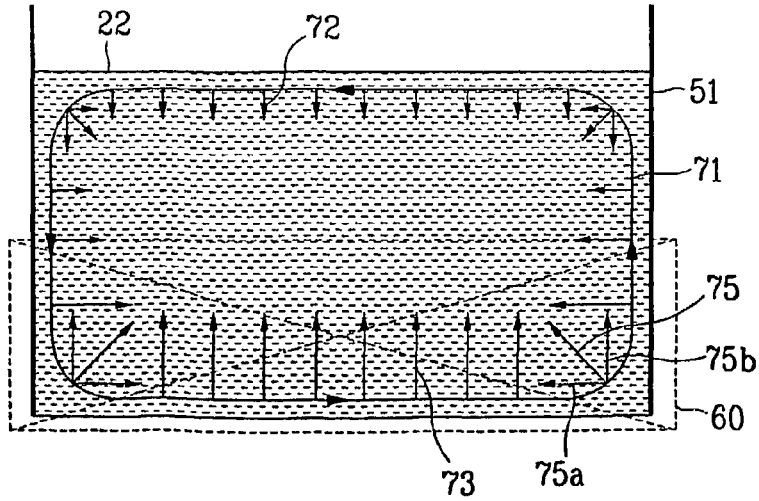
FIG. 13 is a schematic view of an inducement current and an electromagnetic force in a vessel of the holding apparatus of FIG. 10 prior to the formation of a solidification layer.

FIG. 13 is a schematic view of an inducement current and an electromagnetic force in the vessel 51 prior to the formation of solidification layers 55.

An electromagnetic field formed by the AC electromagnet 60 generates an induced current within the molten metal 22 filled in the vessel 51. This induced current forms a single current flow path 71. A Lorentz force expressed by the vector product of the induced current and the electromagnetic field, that is, electromagnetic forces 72, 73, and 75 operates toward a center direction of the current flow path 71, the intensity of which is proportional to the product of the induced current and the electromagnetic field.

Accordingly, with the mounting of the AC electromagnet 60 at the bottom portion of the vessel 51, the electromagnetic force 72 acting on the molten metal 22 in the vicinity of the opening operates in a direction opposite the direction of the gravitational force, and the electromagnetic force 73 acting on the molten metal 22 at an upper end of the vessel 51 operates corresponding to the direction of the gravitational force. Since the strength of the electromagnetic force 72 at the bottom portion of the vessel 51 and close to the AC electromagnet 60 is greater than that of the electromagnetic force 73 in the upper portion of the vessel 51 and relatively far from the AC electromagnet 60, the direction of the overall electromagnetic force in the vessel 51 is opposite the direction of the force of gravity, thereby providing buoyancy to the molten metal 22 in the vessel 51.

In corner areas at the bottom of the vessel 51, the direction of the induced current 71 is changed such that the direction of the electromagnetic force is also changed. In more detail, the electromagnetic force 75 in the bottom corner portions of the vessel 51 includes components 75*a* perpendicular to the gravitational force direction and components 75*b* corresponding to the gravitational force direction.

Past the corner portions in the short side areas, the component 75*b* in the gravitational force direction is no longer a factor and only the component 75*a* perpendicular to the direction of the force of gravity is present. Accordingly, the electromagnetic force opposite the gravitational force direction in the lower corner portions at the short sides of the vessel 51 is substantially weaker than at the center portion of the long sides of the vessel such that a stable floating effect is obtained. This floating effect is even more stably realized with the operation of the molten metal coolers 53 to form the solidification layers 55.

Figure 14:
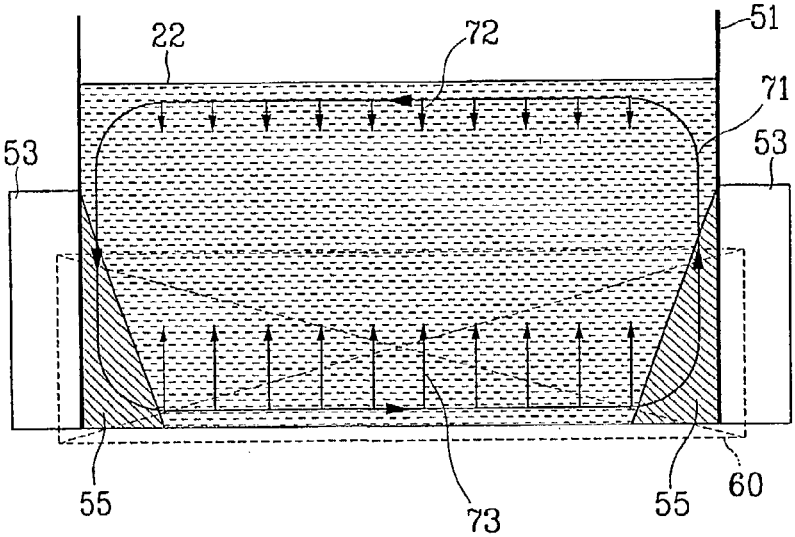
FIG. 14 is a schematic view of an inducement current and an electromagnetic-force in a vessel of the holding apparature of FIG. 10 after the formation of a solidification layer.
Figure 15:
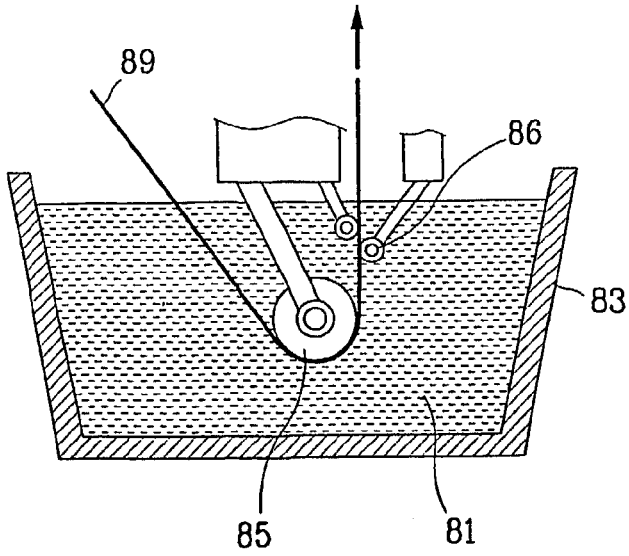
FIG. 15 is a schematic view of a conventional plating apparatus for performing molten plating processes.

FIG. 14 is a schematic view of an inducement current and an electromagnetic force in the vessel after the formation of the solidification layers 55.

As shown in the drawing, the flow path 71 of the induced current is identical to before the formation of the solidification layers 55. However, at the bottom portion of the vessel 51, only components of the electromagnetic force acting on the molten metal that are opposite the gravitational force direction are present. Further, with the formation of the solidification layers 55 at the bottom corner portions and short sides of the vessel 51, only the desired forces are present such that the molten metal 22 is provided with sufficient buoyancy and does not exit through the opening.

The solidification layers 55 are formed in the vessel 51 such that they are attached to inside lower ends of the short sides of the vessel 51. It is preferable that a thickness of the solidification layers 55 is such that the solidification layers 55 extend from the lower ends of the short sides of the vessel 51 to where the electromagnetic components perpendicular to the gravitational force start to be generated.

The method of determining the thickness of the solidification layers 55 will be described in more detail. A distance from the lower ends of the short sides of the vessel 51 to where the electromagnetic components perpendicular to the gravitational force start to be generated is almost identical to a skin depth (δ) of the AC electric field. Accordingly, it is preferable that the solidification layers 55 are formed thicker than the skin depth (δ), which is determined by the molten metal 22 that provides for the thickness of the solidification layers 55 and the frequency of the AC electric field.

The skin depth (δ) is obtained by Equation 1 below.

$$\delta = \frac{1}{\sqrt{2\pi f \sigma \mu}} \qquad \text{[Equation 1]}$$

where f is the frequency of the AC electromagnetic field, σ is the electric conductivity of the molten metal, and $\mu$ is the magnetic permeability.

If the temperatures inside and outside the vessel 51 are known, the thickness of the solidification layers 55 may be determined from Equation 2 below.

$$k_{pot}\frac{(T_{Pi} - T_{Po})}{t_{pot}} = k_{solid}\frac{(T_{in} - T_{Pi})}{t_{solid}} \qquad \text{[Equation 2]}$$

where $t_{pot}$ is the wall thickness of the short side of the vessel 51, $t_{solid}$ is the thickness of the molten metal solidification layers 55, $k_{pot}$ is the thermal conductivity of the vessel 51, $k_{solid}$ is the thermal conductivity of the solidified molten metal, $T_{Po}$ is the outside wall temperature of the vessel 51, $T_{Pi}$ is the inside wall temperature of the vessel 51, and $T_m$ is the temperature at the boundary between the solidification layers 55 and the molten metal 22 and is the solidification point temperature of the metal.

Accordingly, the temperature sensors 57*a* and 57*b* detect $T_{Pi}$ and $T_{Po}$, respectively, so that the thickness ($t_{solid}$) of the solidification layers 55 may be determined. The thickness ($t_{solid}$) of the solidification layers 55 must satisfy Equation 3 below to ensure the stable floating of the molten metal 22.

$$t_{solid} \geqq \delta \qquad \text{[Equation 3]}$$

The following experiment was performed to determine the effects of the molten metal holding apparatus according to the second preferred embodiment of the present invention.

First, the vessel 51 was made of stainless steel at a thickness of 10 mm and a 60 Hz AC magnetic field ($B_{rms}$) was applied at 0.3 T to the opening of the lower portion of the vessel 51. A difference in the temperatures of the inside wall and outside wall of the vessel 51 was maintained at 100° C. or higher, and a lowermost thickness ($t_{solid}$) of the solidification layers 55 of the short sides of the vessel 51 was formed at greater than 55 mm, which is the skin depth (δ) of the molten zinc calculated from Equation 1. Accordingly, the molten zinc 22 filled in the vessel 51 is stably floated to a height of 500 mm from the opening.

At this time, if the difference in the inside wall temperature and the outside wall temperature of the short sides of the vessel 51 is less than 100° C., the thickness ($t_{solid}$) of the solidification layers becomes less than the skin depth (δ) and the exiting of the molten zinc at the short side area occurs. Therefore, the inside wall temperature and the outside wall temperature were detected respectively by the temperature sensors 57*a* and 57*b*, and the controller 61 adjusted the supply valve 63 based on this information such that the temperature difference in the inside wall temperature and the outside wall temperature was maintained at 100° C. or greater, thereby realizing a thickness ($t_{solid}$) of the solidification layers 55 that is greater than the skin depth (δ).

A molten metal holding apparatus according to a third preferred embodiment of the present invention incorporates all the features of the molten metal holding apparatuses of both the first and second preferred embodiments of the present invention.

In particular, the molten metal holding apparatus according to the third preferred embodiment of the present invention includes a vessel that contains molten metal and has formed a slot in a bottom surface, subsidiary vessels for temporarily storing molten metal that overflows from the upper end of the vessel, chambers positioned at a lower end of the vessel and that communicate with the subsidiary vessels via subsidiary tubes and with the vessel via branch openings, AC electromagnets mounted adjacent to outside side surfaces of the vessel and provides buoyancy the molten metal so that the same does not exit the opening of the vessel, and molten metal coolers for forming solidification layers inside the vessel at a lower end of short sides thereof.

The vessel is substantially rectangular in cross section having long sides and short sides. The auxiliary vessels are bucket-shaped and follow an outer circumference of the upper end of the vessel.

Further, the chambers are formed following long side surface of the lower portion of the vessel, and communicates with the vessel through the branch openings that slit-shaped and upwardly slanted toward inside the vessel. A plurality of the subsidiary tubes are provided to communicate the subsidiary vessels with the chambers.

The AC electromagnet includes a core mounted adjacent to outside the long sides of the vessel between the subsidiary vessels and the chambers, and a coil wound around the core and through which an AC current flows. The molten metal coolers are mounted to lower outside surfaces of the short sides of the vessel. When operated, the molten metal coolers form solidification layers inside the vessel at a lower end of the short sides of the same.

The above molten metal holding apparatus further includes a temperature sensor provided at each an inner lower surface of the short sides of the vessel where the solidification layers are formed and an outer lower surface of the short sides of the vessel, a coolant supply valve controlled to regulate the amount of coolant supplied to the molten metal coolers, and a controller connected to the temperature sensors and the coolant supply valve to control the supply amount of coolant according to the detected temperatures to thereby control the thickness of the solidification layers formed inside the vessel.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A molten metal holding apparatus for the continuous hot dip coating of a metal strip, comprising:

a main vessel that is substantially rectangular in cross section having long sides and short sides and has formed a slot-shaped opening in a bottom surface, the vessel containing molten metal;

subsidiary vessels formed in a bucket-shape following an outer circumference of an upper end of the main vessel and for temporarily storing molten metal that overflows from the upper end of the main vessel;

chambers formed outwardly following long sides of a lower end of the main vessel and that communicate with the main vessel via slit-shaped branch openings that are formed at a predetermined slant toward the main vessel;

a plurality of subsidiary tubes communicating the chambers with the subsidiary vessels; and alternating current electromagnets including a core mounted adjacent to outside side surfaces of the main vessel and between the subsidiary vessels and the chambers and a coil wound around the core and to which an alternating current is supplied.

2. The molten metal holding apparatus of claim 1, wherein exhaust openings are formed in upper long sides of the main vessel such that the molten metal may be exhausted from the main vessel to the subsidiary vessels.

3. The molten metal holding apparatus of claim 1, wherein at least one subsidiary tube is formed in each corner portion of the subsidiary vessels.

4. The molten metal holding apparatus of claim 1, wherein the subsidiary tubes are provided outwardly adjacent to a pair of opposing poles of the cores of the electromagnets.

5. The molten metal holding apparatus of claim 1, wherein the subsidiary tubes are provided between opposing poles of the cores of the electromagnets.

6. The molten metal holding apparatus of claim 1, wherein the subsidiary tubes are provided external to yokes of the cores of the electromagnets.

7. The molten metal holding apparatus of claim 1, wherein molten metal supplied through the branch openings have an angle in the range of 30° to 45° with a metal strip supplied through the opening formed in the bottom surface of the main vessel.

8. A molten metal holding apparatus for the continuous hot dip coating of a metal strip, comprising:

a main vessel that is substantially rectangular in cross section having long sides and short sides and has formed a slot-shaped opening in a bottom surface, the vessel containing molten metal;

subsidiary vessels formed in a bucket-shape following an outer circumference of an upper end of the main vessel and for temporarily storing molten metal that overflows from the upper end of the vessel;

chambers formed outwardly following long sides of a lower end of the main vessel and that communicate with the main vessel via slit-shaped branch openings that are formed at a predetermined slant toward the main vessel;

a plurality of subsidiary tubes communicating the chambers with the subsidiary vessels;

alternating current electromagnets including a core mounted adjacent to outside side surfaces of the main vessel and between the subsidiary vessels and the chambers and a coil wound around the core and to which an alternating current is supplied; and molten metal coolers mounted adjacent to outside, lower short side surfaces of the main vessel for forming solidification layers inside the vessel at a lower end of the short sides thereof.

9. The molten metal holding apparatus of claim 8, further comprising:

a temperature sensor provided at each an inner lower surface of the short sides of the main vessel where the solidification layers are formed and an outer lower surface of the short sides of the main vessel;

a coolant supply valve connected to the molten metal coolers and controlled to regulate the amount of coolant supplied to the molten metal coolers; and a controller connected to the temperature sensors and the coolant supply valve to control the supply amount of coolant according to the detected temperatures to thereby control a thickness of the solidification layers formed inside the main vessel.

10. The molten metal holding apparatus of claim 8, wherein exhaust openings are formed in upper long sides of the main vessel such that the molten metal may be exhausted from the main vessel to the subsidiary vessels.

11. The molten metal holding apparatus of claim 8, wherein at least one subsidiary tube is formed in each corner portion of the subsidiary vessels.

12. The molten metal holding apparatus of claim 8, wherein the subsidiary tubes are provided outwardly adjacent to a pair of opposing poles of the cores of the electromagnets.

13. The molten metal holding apparatus of claim 8, wherein the subsidiary tubes are provided between opposing poles of the cores of the electromagnets.

14. The molten metal holding apparatus of claim 8, wherein the subsidiary tubes are provided external to yokes of the cores of the electromagnets.

15. The molten metal holding apparatus of claim 8, wherein molten metal supplied through the branch openings have an angle in the range of 30° to 45° with a metal strip supplied through the opening formed in the bottom surface of the main vessel.

* * * * *